US010836613B2

(12) United States Patent
Gustafsson et al.

(10) Patent No.: US 10,836,613 B2
(45) Date of Patent: Nov. 17, 2020

(54) HYDRAULIC CRANE

(71) Applicant: Cargotec Patenter AB, Ljungby (SE)

(72) Inventors: Per Gustafsson, Hudiksvall (SE); Sten Sirén, Pargas (FI)

(73) Assignee: Cargotec Patenter AB, Ljungby (SE)

( * ) Notice: Subject to any disclaimer, the term of this patent is extended or adjusted under 35 U.S.C. 154(b) by 157 days.

(21) Appl. No.: 16/308,988

(22) PCT Filed: May 17, 2017

(86) PCT No.: PCT/EP2017/061889
§ 371 (c)(1),
(2) Date: Dec. 11, 2018

(87) PCT Pub. No.: WO2017/215876
PCT Pub. Date: Dec. 21, 2017

(65) Prior Publication Data

US 2019/0308851 A1 Oct. 10, 2019

(30) Foreign Application Priority Data

Jun. 13, 2016 (EP) ..... 16174121

(51) Int. Cl.
*B66C 13/48* (2006.01)
*B66C 23/14* (2006.01)
(Continued)

(52) U.S. Cl.
CPC ..... *B66C 13/48* (2013.01); *B66C 13/20* (2013.01); *B66C 13/44* (2013.01); *B66C 15/045* (2013.01);
(Continued)

(58) Field of Classification Search
USPC ..... 701/50
See application file for complete search history.

(56) References Cited

U.S. PATENT DOCUMENTS 3,554,317 A * 1/1971 Birbanescu ..... B66F 11/048 182/14
8,684,437 B1 * 4/2014 Collins ..... B65F 3/001 296/183.2
(Continued)

FOREIGN PATENT DOCUMENTS

CN 201358142 Y 12/2009
WO 2012028032 A1 3/2012
WO 2015113084 A1 8/2015

*Primary Examiner* — Tyler D Paige
(74) *Attorney, Agent, or Firm* — Dilworth & Barrese, LLP

(57) ABSTRACT

A hydraulic crane comprising: —a rotatable column (7); —a crane boom system comprising a first crane boom (11) connected to the column; and —an electronic control device for controlling the movement of the column and the crane boom system on the basis of control signals from a manoeuvring unit and a calculation model for boom tip control. The control device is configured to switch from a first control mode into a second control mode when the first crane boom is about to interfere with an obstacle. In the first control mode, the control device controls the crane boom movements in accordance with an ordinary control strategy. In the second control mode, the control device makes the load suspension point (P) of the crane boom system move along the trajectory defined by said control signals while controlling the crane boom movements in accordance with an auxiliary control strategy in which the first crane boom is prevented from interfering with the obstacle.

16 Claims, 4 Drawing Sheets

(51) Int. Cl.

| | |
|---|---|
| ***B66C 13/20*** | (2006.01) |
| ***B66C 13/44*** | (2006.01) |
| ***B66C 15/04*** | (2006.01) |
| ***B66C 23/42*** | (2006.01) |
| ***B66C 23/00*** | (2006.01) |
| ***B66C 23/70*** | (2006.01) |
| ***B66C 23/88*** | (2006.01) |
| ***B66C 23/48*** | (2006.01) |
| *B66C 23/78* | (2006.01) |

(52) U.S. Cl.
CPC ..... *B66C 23/14* (2013.01); *B66C 23/42* (2013.01); *B66C 23/48* (2013.01); *B66C 23/54* (2013.01); *B66C 23/701* (2013.01); *B66C 23/88* (2013.01); *B66C 23/78* (2013.01)

(56) References Cited

U.S. PATENT DOCUMENTS

| | | | | |
|---|---|---|---|---|
| 2004/0164042 | A1* | 8/2004 | Schneider | B66C 23/66 212/278 |
| 2006/0045661 | A1* | 3/2006 | Andersson | B66C 23/90 414/140.3 |
| 2015/0161872 | A1* | 6/2015 | Beaulieu | G01S 13/06 340/686.6 |
| 2015/0289449 | A1* | 10/2015 | Greer | A01D 90/083 414/24.5 |
| 2016/0176686 | A1* | 6/2016 | Schoonmaker | B66C 15/045 701/50 |
| 2018/0170719 | A1* | 6/2018 | Tasch | G01S 13/93 |
| 2018/0292223 | A1* | 10/2018 | Leach | B64C 39/02 |
| 2019/0241408 | A1* | 8/2019 | Strahl | B66C 13/46 |
| 2019/0308851 | A1* | 10/2019 | Gustafsson | B66C 15/045 |

* cited by examiner

HYDRAULIC CRANE

FIELD OF THE INVENTION AND PRIOR ART

The present invention relates to a hydraulic crane according to the description herein.

A hydraulic crane, for instance in the form of a lorry crane or forestry crane, normally comprises a column, which is rotatable about a vertical axis of rotation, and a crane boom system, which is mounted to the column and which is intended to carry a load in a load suspension point at an outer end of the crane boom system, wherein the crane boom system comprises two or more liftable and lowerable crane booms which form a connection between the load suspension point and the column and which are articulately connected to each other. The crane also comprises a manoeuvring unit with one or more maneuvering members configured to be manoeuvrable by a crane operator in order to control the crane boom movements. In order to facilitate for the operator to control the position of the load suspension point in an accurate manner, the control of the crane boom movements is with advantage based on so-called boom tip control. In the case of boom tip control, a first maneuvering member may be used for controlling the rotation of the column, a second maneuvering member may be used for controlling the movement of the load suspension point in a vertical direction in order to control the height of the load suspension point and a third maneuvering member may be used for controlling the movement of the load suspension point in a horizontal direction in order to control the lifting radius. The manoeuvring unit could as an alternative be provided with a maneuvering member in the form of a joystick to be used for controlling the movement of the load suspension point in the vertical and horizontal directions. In connection with boom tip control, the individual movements of the crane booms of the crane boom system are regulated by an electronic control device based on control signals from the manoeuvring unit and a calculation model for boom tip control, wherein the calculation model is established by the crane manufacturer in accordance with a given control strategy. Thus, when boom tip control is used, the crane operator has no direct control over the positioning of the individual crane booms. On the contrary, the electronic control device calculates how the individual crane booms should be moved in order to make the load suspension point follow the trajectory specified by the crane operator via the manoeuvring unit.

The load suspension point of an ordinary lorry crane may be provided at the outer end of a crane boom in the form of a so-called outer boom, which is telescopically extensible and articulately connected to another crane boom in the form of a so-called inner boom, wherein the inner boom in its turn is articulately connected to the rotatable column of the crane. When a crane operator controls such a crane based on boom tip control, the crane operator normally has his attention directed to the load suspension point at the outer end of the outer boom and is not always aware of the prevailing position and the coming movements of the inner boom, which implies that there is a risk for the inner boom to collide with the driver's cab of the lorry or any other obstacle within the working area of the crane.

OBJECT OF THE INVENTION

The object of the present invention is to provide a solution to the above-mentioned problem.

SUMMARY OF THE INVENTION

According to the present invention, said object is achieved by a hydraulic crane having the features defined herein.

The hydraulic crane according to the present invention comprises:

- a crane base;
- a column which is rotatably mounted to the crane base so as to be rotatable in relation to the crane base about an essentially vertical axis of rotation;
- an actuating device for rotating the column in relation to the crane base;
- a crane boom system comprising two or more liftable and lowerable crane booms which are articulately connected to each other and hydraulic cylinders for lifting and lowering the crane booms, wherein a first crane boom of the crane boom system is articulately connected to the column and a second crane boom of the crane boom system is articulately connected to the first crane boom;
- an electronic control device for controlling said actuating device and the hydraulic cylinders of the crane boom system to thereby control the rotation of the column and the positioning of the crane booms; and
- a manoeuvring unit with one or more maneuvering members configured to be manoeuvrable by a crane operator in order to control the position of a load suspension point of the crane boom system, wherein the manoeuvring unit is configured to supply the electronic control device with control signals related to the manoeuvring of said one or more maneuvering members. The electronic control device is configured to control the crane boom movements on the basis of said control signals and a calculation model for boom tip control, wherein the electronic control device in a first control mode is configured to make the load suspension point move along a trajectory defined by said control signals while controlling the crane boom movements in accordance with an ordinary control strategy. The electronic control device is configured to switch from the first control mode into a second control mode when it is established by the electronic control device that the first crane boom is about to interfere with a predefined safety zone associated with a known obstacle or about to interfere with an obstacle detected by means of one or more sensors of the hydraulic crane, wherein the electronic control device in this second control mode is configured to make the load suspension point move along said trajectory while controlling the crane boom movements in accordance with an auxiliary control strategy in which the first crane boom is prevented from interfering with the safety zone or the detected obstacle.

Hereby, the first crane boom is automatically prevented from colliding with the obstacle without affecting the desired movement of the load suspension point ordered by the crane operator, and the crane operator may thereby keep his attention directed to the load suspension point at the outer end of the crane boom system without jeopardizing the safety of the crane.

Further advantages as well as advantageous features of the hydraulic crane according to the invention will appear from the following description.

BRIEF DESCRIPTION OF THE DRAWINGS

The invention will in the following be more closely described by means of embodiment examples, with reference to the appended drawings. In the drawings.

DETAILED DESCRIPTION OF EMBODIMENTS OF THE INVENTION

In this description, the expression "liftable and lowerable crane boom" refers to a crane boom which can be pivoted in a vertical plane so as to thereby perform liftings and lowerings of a load carried by the crane. The expression "hydraulic cylinder for lifting and lowering the crane boom" here refers to the hydraulic cylinder which is associated with the liftable and lowerable crane boom and which carries out the pivoting thereof in a vertical plane.

Figure 1:
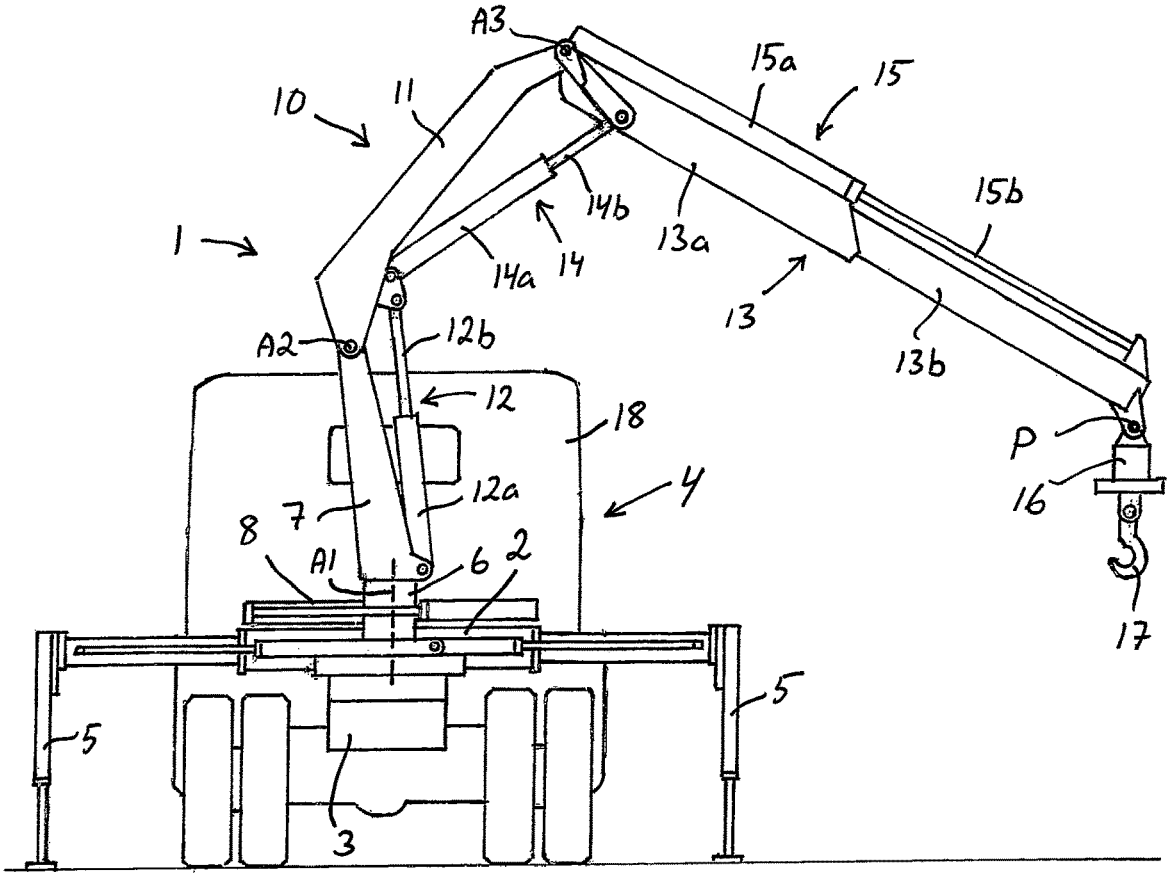
FIG. 1 is a schematic rear view of a lorry provided with a hydraulic crane according to an embodiment of the present invention.

FIG. 1 shows a hydraulic crane 1 mounted on a frame 2, which in the illustrated embodiment is connected to the chassis 3 of a lorry 4. The frame 2 is provided with adjustable support legs 5 for supporting the crane 1.

The crane 1 comprises:

- a crane base 6, which is fixed to the frame 2;
- a column 7, which is rotatably mounted to the crane base 6 so as to be rotatable in relation to the crane base about an essentially vertical axis of rotation A1 by means of an actuating device 8;
- a liftable and lowerable first crane boom 11, here denominated inner boom, which is articulately connected to the column 7 in such a manner that it is pivotable in relation to the column about an essentially horizontal axis of rotation A2;
- a first hydraulic cylinder 12, here denominated lifting cylinder, for lifting and lowering the inner boom 11 in relation to the column 7;
- a liftable and lowerable second crane boom 13, here denominated outer boom, which is articulately connected to the inner boom 11 in such a manner that it is pivotable in relation to the inner boom about an essentially horizontal axis of rotation A3; and
- a second hydraulic cylinder 14, here denominated outer boom cylinder, for lifting and lowering of the outer boom 13 in relation to the inner boom 11.

In the illustrated example, the lifting cylinder 12 comprises a cylinder part 12*a* which is articulately connected to the column 7, and a piston which is received in the cylinder part 12*a* and displaceable in relation to it, wherein the piston is fixed to a piston rod 12*b* which is articulately connected to the inner boom 11. The outer boom cylinder 14 comprises a cylinder part 14*a* which is articulately connected to the inner boom 11, and a piston which is received in the cylinder part 14*a* and displaceable in relation to it, wherein the piston is fixed a piston rod 14*b* which is articulately connected to the outer boom 13.

In the illustrated embodiment, the crane boom system 10 of the crane 1 is formed by the inner boom 11 and the outer boom 13 and the associated hydraulic cylinders. However, the crane boom system 10 of the crane 1 may also include more than two liftable and lowerable crane booms articulately connected to each other. As an example, a liftable and lowerable crane boom in the form of a so-called jib may be mounted to the outer end of the outer boom 13 to thereby make it possible to perform lifting operations requiring a greater range.

The outer boom 13 is telescopically extensible to enable an adjustment of the extension length L thereof. In the illustrated example, the outer boom 13 comprises one telescopic crane boom section 13*b*, which is slidably received in a base section 13*a* of the outer boom 13 and displaceable in the longitudinal direction of the base section 13*a* for adjustment of the extension length L of the outer boom 13. The telescopic crane boom section 13*b* is displaceable in relation to the base section 13*a* by means of a hydraulic cylinder 15 carried by the outer boom 13. In the illustrated example, this hydraulic cylinder 15 comprises a cylinder part 15*a* which is fixed to the base section 13*a*, and a piston which is received in the cylinder part 15*a* and displaceable in relation to it, wherein the piston is fixed to a piston rod 15*b* which is fixed to the telescopic crane boom section 13*b*. As an alternative, the outer boom 13 could comprise two or more telescopic crane boom sections 13*b* which are mutually slidable in relation to each other in the longitudinal direction of the outer boom 13 for adjustment of the extension length thereof.

In the illustrated embodiment, a rotator 16 is articulately fastened to a load suspension point P at the outer end of the outer boom 13, which rotator in its turn carries a lifting hook 17. In this case, the load to be carried by the crane 1 is fixed to the lifting hook 17, for instance by means of lifting wires or the similar.

The control system for controlling the hydraulic cylinders 12, 14, 15 of the crane boom system 10 comprises a pump 20 (see FIG. 6) which pumps hydraulic fluid from a reservoir 21 to a directional-control-valve block 22. The directional-control-valve block 22 comprises a directional-control-valve section 23 for each of the hydraulic cylinders 12, 14 and 15 of the crane boom system 10, to which hydraulic cylinders hydraulic fluid is supplied in a conventional manner in dependence on the setting position of the slide member in the respective directional-control-valve section 23.

Figure 2:
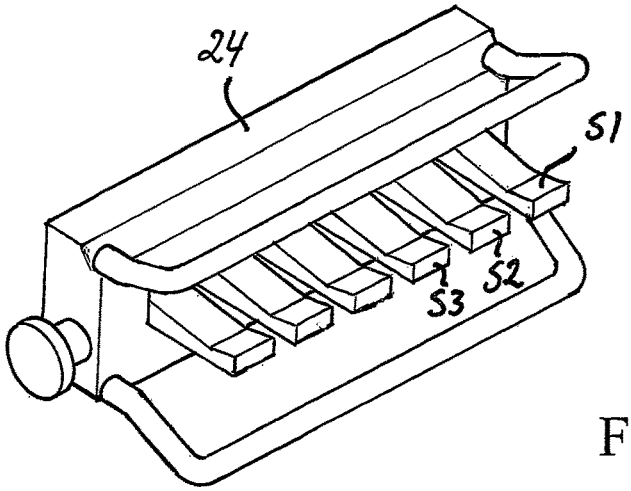
FIG. 2 is a schematic perspective view of a manoeuvring unit with a number of manoeuvring members for controlling different crane functions.
Figure 3A:
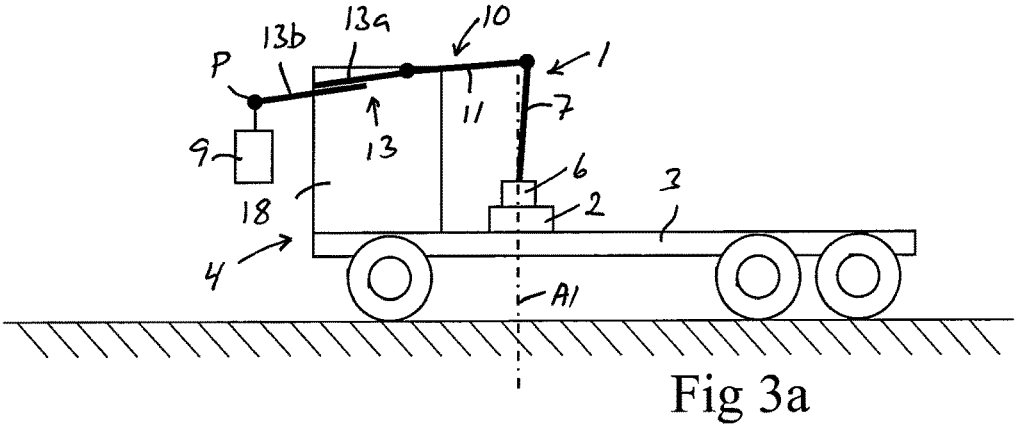
FIG. 3*a* is an outline diagram of the crane of FIG. 1, as seen in a lateral view with the load suspension point of the crane in a first position.
Figure 3B:
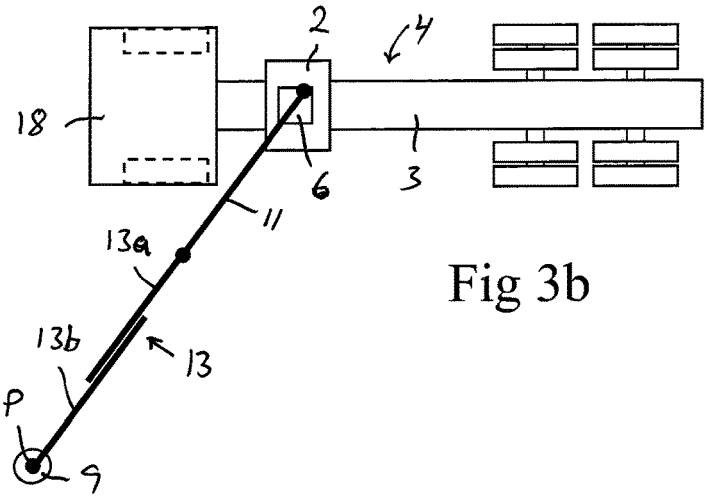
FIG. 3*b* is an outline diagram of the crane of FIG. 1, as seen in a planar view from above with the load suspension point of the crane in said first position.

The crane 1 comprises a manoeuvring unit 24 (see FIG. 2) with one or more maneuvering members S1-S3 configured to be manoeuvrable by a crane operator in order to control the position of the load suspension point P of the crane boom system 10. Control signals are transmitted via cable or a wireless connection from the manoeuvring unit 24 to an electronic control device 25, for instance in the form of a microprocessor, which in its turn controls the setting position of the slide members in the valve sections 23 of the directional-control-valve block 22 in dependence on control signals from the manoeuvring unit 24 related to the manoeuvring of the maneuvering members S1-S3.

The electronic control device 25 is configured to control the crane boom movements on the basis of the control signals from the manoeuvring unit 24 and a calculation model for boom tip control. The calculation model may for instance be stored as an algorithm in a memory of the electronic control device 25. A first maneuvering member S1 may be used for controlling the rotation of the column 7 in relation to the crane base 6 about the vertical axis of rotation A1, a second maneuvering member S2 may be used for controlling the movement of the load suspension point P in a vertical direction in order to control the height of the load suspension point P and a third maneuvering member S3 may be used for controlling the movement of the load suspension point P in a horizontal direction in order to control the lifting radius, i.e. the horizontal distance between the load suspension point P and the vertical axis of rotation A1. The manoeuvring unit 24 could as an alternative be provided with a maneuvering member in the form of a joystick to be used for controlling the movement of the load suspension point P in the vertical and horizontal directions.

Figure 6:
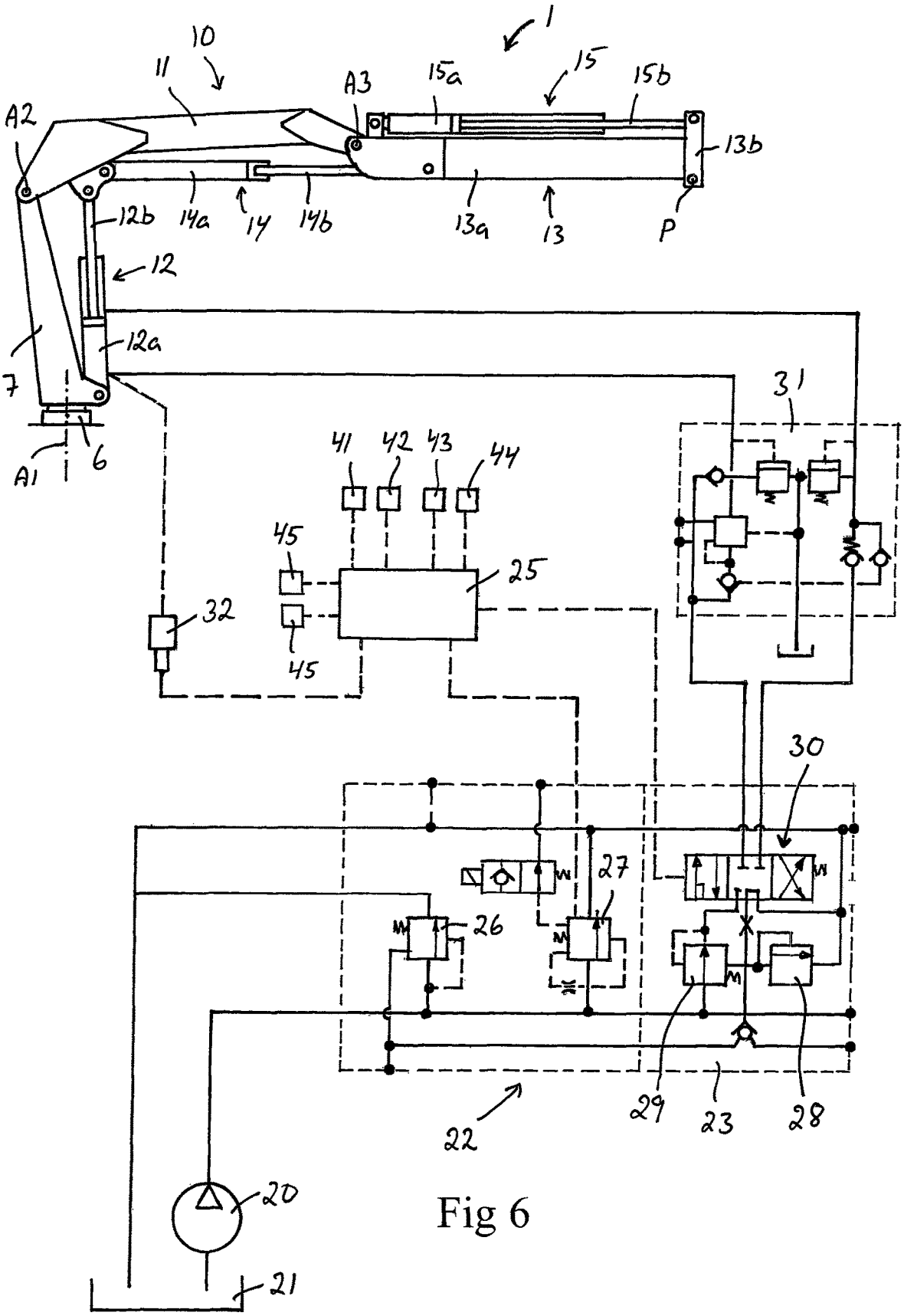
FIG. 6 is a schematic illustration of a hydraulic crane according to an embodiment of the invention.

Each individual directional-control-valve section 23 controls the magnitude and the direction of the flow of hydraulic fluid to a specific hydraulic cylinder 12, 14, 15 and thereby controls a specific crane function. For the sake of clarity, only the directional-control-valve section 23 for the lifting cylinder 12 is illustrated in FIG. 6.

The directional-control-valve block 22 further comprises a shunt valve 26, which pumps excessive hydraulic fluid back to the reservoir 21, and an electrically controlled dump valve 27, which can be made to return the entire hydraulic flow from the pump 20 directly back to the reservoir 21.

In the illustrated example, the directional-control-valve block 22 is of load-sensing and pressure-compensating type, which implies that the magnitude of the hydraulic flow supplied to a hydraulic cylinder is always proportional to the position of the slide member in the corresponding directional-control-valve section 23. The directional-control-valve section 23 comprises a pressure limiter 28, a pressure compensator 29 and a directional-control-valve 30. Directional-control-valve blocks and directional-control-valve sections of this type are known and available on the market. Also other types of valve devices then the one here described may of course be used in a crane according to the present invention.

A load holding valve 31 is arranged between the respective hydraulic cylinder 12, 14, 15 and the associated directional-control-valve section 23, which load holding valve makes sure that the load will remain hanging when the hydraulic system runs out of pressure when the dump valve 27 is made to return the entire hydraulic flow from the pump 20 directly back to the reservoir 21.

Sensors 41, 42, 43, 44 (schematically illustrated in FIG. 6) are connected to the electronic control device 25 and configured to establish values of variables α, β, L, θ (see FIG. 4*a*) which are related to the prevailing position of the crane booms 11, 13 of the crane boom system 10. In a crane 1 with the configuration illustrated in FIGS. 1, 3-5 and 6, said variables comprise:

- a variable α representing the angle of inclination of the inner boom 11;
- a variable β representing the angle of inclination of the outer boom 13;
- a variable L representing the extension length of the outer boom 13; and
- a variable θ representing the slewing angle of the column 7. The angles of inclination α, β, the extension length L and the slewing angle θ together define the position of the crane boom system 10 and the load suspension point P of the crane according to FIGS. 1, 3-5 and 6, and these variables will consequently provide complete information about the prevailing position of the crane boom system 10 and the crane booms 11, 13 included therein.

Figure 4A:
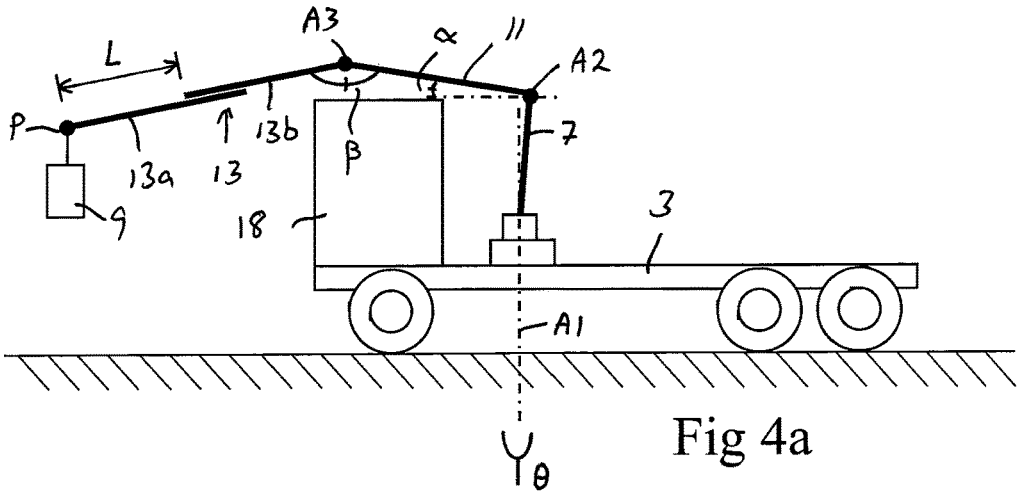
FIG. 4*a* is an outline diagram of the crane of FIG. 1, as seen in a lateral view corresponding to FIG. 3*a* and with the load suspension point of the crane in a second position.
Figure 4B:
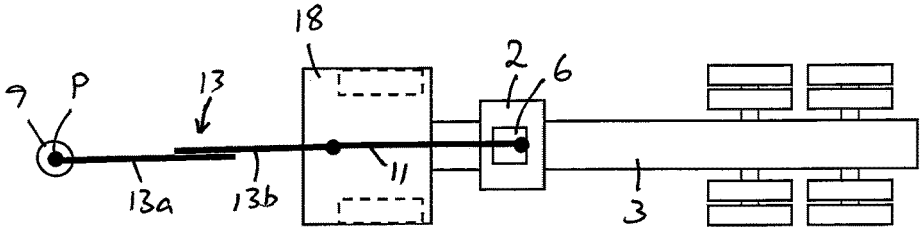
FIG. 4*b* is an outline diagram of the crane of FIG. 1, as seen in a planar view corresponding to FIG. 3*b* and with the load suspension point of the crane in said second position.
Figure 5A:
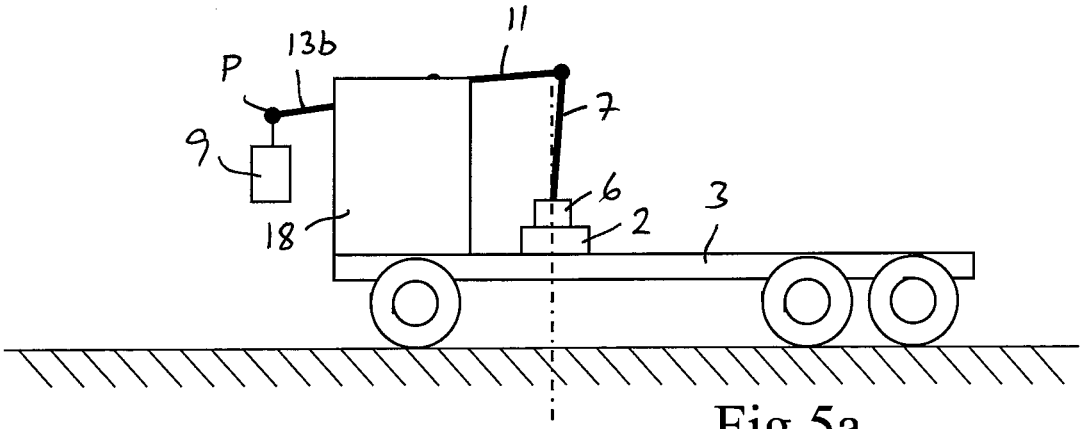
FIG. 5*a* is an outline diagram of the crane of FIG. 1, as seen in a lateral view corresponding to FIG. 3*a* and with the load suspension point of the crane in a third position.
Figure 5B:
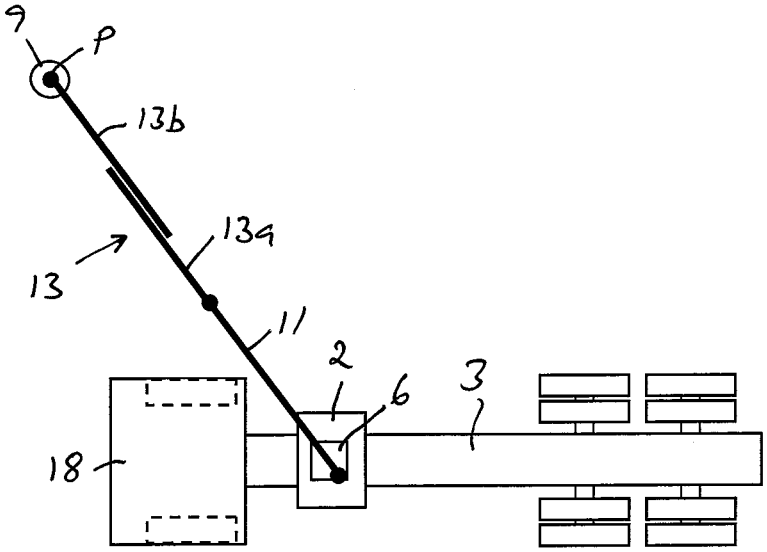
FIG. 5*b* is an outline diagram of the crane of FIG. 1, as seen in a planar view corresponding to FIG. 3*b* and with the load suspension point of the crane in said third position.

In the example illustrated in FIG. 4*a*, the angle of inclination α of the inner boom 11 is defined as the angle between the longitudinal axis of the inner boom 11 and the horizontal plane, whereas the angle of inclination β of the outer boom 13 is defined as the angle between the longitudinal axis of the outer boom 13 and the longitudinal axis of the inner boom 11.

The angle of inclination α of the inner boom 11 may for instance be established by means of a sensor 41 which continuously senses the position of the piston rod 12*b* in relation to the cylinder part 12*a* of the lifting cylinder 12, whereas the angle of inclination β of the outer boom 13 may be established by means of a sensor 42 which continuously senses the position of the piston rod 14*b* in relation to the cylinder part 14*a* of the outer boom cylinder 14. The angle of inclination α is a function of the extension position of the piston rod 12*b* of the lifting cylinder 12, and the angle of inclination β is a function of the extension position of the piston rod 14*b* of the outer boom cylinder 14. Alternatively, these angles of inclination α, β could be established by means of suitable angle sensors, which directly sense the respective angle of inclination.

The extension length L of the outer boom 13 may for instance be established by means of a sensor 43 which continuously senses the position of the piston rod 15*b* in relation to the cylinder part 15*a* of the hydraulic cylinder 15. Alternatively, the extension length L could be established by means of a measuring device comprising an ultrasonic transmitter and an ultrasonic receiver of the type described in U.S. Pat. No. 5,877,693 A or by means of any other suitable measuring device.

The slewing angle θ of the column 7 in relation to the crane base 6 is established by means of a sensor 44 which continuously senses the slewing position of the column.

The electronic control device 25 is connected to the above-mentioned sensors 41, 42, 43, 44 in order to receive measuring signals from these sensors related to the angles of inclination α, R, the extension length L and the slewing angle θ.

Two different control modes, in the following denominated first and second control modes, are provided for the electronic control device 25. In the first control mode the electronic control device 25 is configured to make the load suspension point P move along a trajectory defined by the above-mentioned control signals from the manoeuvring unit 24 while controlling the crane boom movements in accordance with an ordinary control strategy. The ordinary control strategy may be focused on the optimization of the lifting capacity of the crane 1, in which case the electronic control device 25 is configured to make the crane booms 11, 13 move into positions which will give as high lifting capacity as possible in each position assumed by the load suspension point P. As a further alternative, the ordinary control strategy may be focused on the minimization of the energy consumption of the crane 1, in which case the electronic control device 25 is configured to effect crane boom movements which will give the lowest possible energy consumption. The ordinary control strategy may also be based on other criteria.

The electronic control device 25 is configured to switch from the first control mode into the second control mode when it is established by the electronic control device 25 that the inner boom 11 is about to interfere with a predefined safety zone associated with a known obstacle 18 or about to interfere with an obstacle detected by means of one or more sensors 45 (schematically illustrated in FIG. 6) connected to the electronic control device 25. The last-mentioned sensors 45 may for instance comprise one or more ultrasonic sensors mounted to the inner boom 11 and/or the outer boom 13.

In the second control mode, the electronic control device 25 is configured to make the load suspension point P move along the trajectory defined by the above-mentioned control signals from the manoeuvring unit 24 while controlling the crane boom movements in accordance with an auxiliary control strategy in which the first crane boom 11 is prevented from interfering with the safety zone or the detected obstacle. The auxiliary control strategy is mainly focused on the positioning of the inner boom 11 in safe positions in relation to a known or detected obstacle within the working area of the crane 1.

The electronic control device 25 may be configured to also take into account the position of the outer boom 13 in relation to the safety zone or the detected obstacle in order to automatically prevent also the outer boom 13 from interfering with the safety zone or the detected obstacle.

The safety zone is preferably defined as a set of limit values $V\alpha_{limit}$ for the angle of inclination $\alpha$ of the inner boom 11, wherein each limit value $V\alpha_{limit}$ of the set of limit values is associated with a given slewing angle $\theta$ of the column 7 and represents a limit for the allowed inclination of the inner boom 11 in a vertical plane downwards or upwards at the associated slewing angle $\theta$ of the column 7.

The electronic control device 25 is configured to stop presently executed crane boom movements when it has been established by the electronic control device that the crane booms 11, 13 of the crane boom system 10 cannot be positioned to move the load suspension point P along the trajectory defined by said control signals without the inner boom 11 interfering with the safety zone or the detected obstacle.

The electronic control device 25 is also, in a conventional manner, configured to prevent an execution of crane boom movements that would make the lifting moment of the crane 1 exceed a lifting moment maximum value $M_{max}$ representing a maximum allowed value for the lifting moment of the crane 1. The electronic control device 25 is with advantage, in a conventional manner, adapted to convert the lifting moment maximum value $M_{max}$ into a corresponding value for the maximum allowed working pressure for the lifting cylinder 12. In the embodiment illustrated in FIG. 6, the crane 1 comprises a pressure sensor 32 which is arranged to measure the hydraulic pressure on the piston side of the lifting cylinder 12. The electronic control device 25 is connected to the pressure sensor 32 in order to receive measuring signals from this sensor related to said hydraulic pressure. The electronic control device 25 continuously reads the output signals from the pressure sensor 32 and compares the output signal from the pressure sensor with the established value of the maximum allowed working pressure for the lifting cylinder 12. If the pressure sensed by the pressure sensor 32 exceeds the established maximum allowed working pressure for the lifting cylinder 12, the electronic control device 25 delivers a signal to the dump valve 27, which dumps the hydraulic flow directly to the reservoir 21, which results in that the hydraulic system runs out of pressure and that the presently executed crane boom movements are stopped. In this situation, the load 9 is held by means of the load holding valve 31.

In the embodiment illustrated in FIGS. 1-5, the above-mentioned safety zone is associated with a known obstacle 18 in the form of the driver's cab of the lorry 4. As long as the column 7 is in such a rotational position in relation to the driver's cab 18 that the inner boom 11 may assume any angle of inclination $\alpha$ without interfering with the driver's cab, the electronic control device 25 is configured to apply the above-mentioned first control mode and control the crane boom movements in accordance with the ordinary control strategy. FIGS. 3*a* and 3*b* illustrates a situation in which the inner boom 11 may assume any angle of inclination $\alpha$ without interfering with the driver's cab 18 but will collide with the driver's cab 18 if the crane boom system 10 is subjected to a mere rotation towards the driver's cab by a rotation of the column 7. When the crane operator orders a movement of the load suspension point P from the position illustrated in FIGS. 3*a* and 3*b* to the position illustrated in FIGS. 4*a* and 4*b*, i.e. a rotation of the crane boom system 10 towards the driver's cab 18 without any movement of the load suspension point P in vertical direction, the electronic control device 25 will establish that the inner boom 11 is about to interfere with the safety zone associated with the driver's cab 18 and will consequently switch from the first control mode to the second control mode, whereupon the electronic control device 25 will control the crane boom movements in such a manner that the inner boom 11 is automatically raised and the angle of inclination $\beta$ and the extension length L of the outer boom 13 are automatically modified so as to allow the inner boom 11 to run free of the driver's cab 18 and at the same time allow the load suspension point P to follow the trajectory ordered by the crane operator. When the movement of the load suspension point P continues from the position illustrated in FIGS. 4*a* and 4*b* to the position illustrated in FIGS. 5*a* and 5*b* the electronic control device 25 will establish that the inner boom 11 leaves the area above the safety zone associated with the driver's cab 18 and will then switch back to the first control mode and continue to control the crane boom movements in accordance with the ordinary control strategy, which implies that the angle of inclination $\alpha$ of the inner boom 11 and the angle of inclination $\beta$ and the extension length L of the outer boom 13 are automatically modified.

The electronic control device 25 may be implemented by one single electronic control unit, as illustrated in FIG. 6. However, the electronic control device 25 could as an alternative be implemented by two or more mutually co-operating electronic control units.

The invention is of course not in any way limited to the embodiments described above. On the contrary, several possibilities to modifications thereof should be apparent to a person skilled in the art without thereby deviating from the basic idea of the invention as defined in the appended claims. The control system of the crane may for instance have another design than the control system which is illustrated in FIG. 6 and described above. Furthermore, the crane boom system of the crane could have another design than the crane boom system which is illustrated in drawings and described above.

The invention claimed is:

1. A hydraulic crane comprising:

a crane base (6);

a column (7) which is rotatably mounted to the crane base (6) to be rotatable in relation to the crane base about an essentially vertical axis of rotation (A1);

an actuating device (8) for rotating the column (7) in relation to the crane base (6);

a crane boom system (10) comprising two or more liftable and lowerable crane booms (11, 13) which are articulately connected to each other and hydraulic cylinders (12, 14) for lifting and lowering the crane booms (11, 13), wherein a first crane boom (11) of the crane boom system is articulately connected to the column (7) and a second crane boom (13) of the crane boom system is articulately connected to the first crane boom (11);

an electronic control device (25) for controlling said actuating device (8) and the hydraulic cylinders (12, 14) of the crane boom system (10) to thereby control the rotation of the column (7) and the positioning of the crane booms (11, 13); and a manoeuvring unit (24) with one or more maneuvering members (S1, S2, S3) configured to be manoeuvrable by a crane operator to control the position of a load suspension point (P) of the crane boom system (10), wherein the manoeuvring unit (24) is configured to supply the electronic control device (25) with control signals related to the manoeuvring of said one or more maneuvering members (S1, S2, S3), wherein the electronic control device (25) is configured to control the crane boom movements on the basis of said control signals and a calculation model for boom tip control, the electronic control device (25) in a first control mode is configured to make the load suspension point (P) move along a trajectory defined by said control signals while controlling the crane boom movements in accordance with an ordinary control strategy, the electronic control device (25) is configured to switch from the first control mode into a second control mode when it is established by the electronic control device (25) that the first crane boom (11) is about to interfere with a predefined safety zone associated with a known obstacle (18) or about to interfere with an obstacle detected by one or more sensors (45) of the hydraulic crane (1), and the electronic control device (25) in this second control mode is configured to make the load suspension point (P) move along said trajectory while controlling the crane boom movements in accordance with an auxiliary control strategy in which the first crane boom (11) is prevented from interfering with the safety zone or the detected obstacle.

2. A hydraulic crane according to claim 1, wherein said safety zone is defined as a set of limit values (Vαlimit) for the angle of inclination (α) of the first crane boom (11), and each limit value (Vαlimit) of the set of limit values is associated with a given slewing angle (θ) of the column (7) and represents a limit for the allowed inclination of the first crane boom (11) in a vertical plane downwards or upwards at the associated slewing angle (θ) of the column (7).

3. A hydraulic crane according to claim 1, wherein the hydraulic crane (1) is a lorry crane mounted to the chassis of a lorry (4), and said safety zone is associated with a driver's cab (18) of the lorry.

4. A hydraulic crane according to claim 1, wherein the second crane boom (13) is telescopically extensible to enable an adjustment of the extension length (L) thereof.

5. A hydraulic crane according to claim 1, wherein the electronic control device (25) is configured to stop presently executed crane boom movements when it has been established by the electronic control device that the crane booms (11, 13) of the crane boom system (10) cannot be positioned to move the load suspension point (P) along said trajectory without the first crane boom (11) interfering with the safety zone or the detected obstacle.

6. A hydraulic crane according to claim 2, wherein the hydraulic crane (1) is a lorry crane mounted to the chassis of a lorry (4), and said safety zone is associated with a driver's cab (18) of the lorry.

7. A hydraulic crane according to claim 6, wherein the second crane boom (13) is telescopically extensible to enable an adjustment of the extension length (L) thereof.

8. A hydraulic crane according to claim 3, wherein the second crane boom (13) is telescopically extensible to enable an adjustment of the extension length (L) thereof.

9. A hydraulic crane according to claim 2, wherein the second crane boom (13) is telescopically extensible to enable an adjustment of the extension length (L) thereof.

10. A hydraulic crane according to claim 9, wherein the electronic control device (25) is configured to stop presently executed crane boom movements when it has been established by the electronic control device that the crane booms (11, 13) of the crane boom system (10) cannot be positioned to move the load suspension point (P) along said trajectory without the first crane boom (11) interfering with the safety zone or the detected obstacle.

11. A hydraulic crane according to claim 8, wherein the electronic control device (25) is configured to stop presently executed crane boom movements when it has been established by the electronic control device that the crane booms (11, 13) of the crane boom system (10) cannot be positioned to move the load suspension point (P) along said trajectory without the first crane boom (11) interfering with the safety zone or the detected obstacle.

12. A hydraulic crane according to claim 7, wherein the electronic control device (25) is configured to stop presently executed crane boom movements when it has been established by the electronic control device that the crane booms (11, 13) of the crane boom system (10) cannot be positioned to move the load suspension point (P) along said trajectory without the first crane boom (11) interfering with the safety zone or the detected obstacle.

13. A hydraulic crane according to claim 6, wherein the electronic control device (25) is configured to stop presently executed crane boom movements when it has been established by the electronic control device that the crane booms (11, 13) of the crane boom system (10) cannot be positioned to move the load suspension point (P) along said trajectory without the first crane boom (11) interfering with the safety zone or the detected obstacle.

14. A hydraulic crane according to claim 4, wherein the electronic control device (25) is configured to stop presently executed crane boom movements when it has been established by the electronic control device that the crane booms (11, 13) of the crane boom system (10) cannot be positioned to move the load suspension point (P) along said trajectory without the first crane boom (11) interfering with the safety zone or the detected obstacle.

15. A hydraulic crane according to claim 3, wherein the electronic control device (25) is configured to stop presently executed crane boom movements when it has been established by the electronic control device that the crane booms (11, 13) of the crane boom system (10) cannot be positioned to move the load suspension point (P) along said trajectory without the first crane boom (11) interfering with the safety zone or the detected obstacle.

16. A hydraulic crane according to claim 2, wherein the electronic control device (25) is configured to stop presently executed crane boom movements when it has been established by the electronic control device that the crane booms (11, 13) of the crane boom system (10) cannot be positioned to move the load suspension point (P) along said trajectory without the first crane boom (11) interfering with the safety zone or the detected obstacle.

* * * * *